US005395583A

United States Patent [19]

Potgieter et al.

[11] Patent Number: 5,395,583

[45] Date of Patent: Mar. 7, 1995

[54] STAINLESS STEEL COMPOSITION

[75] Inventors: Johannes H. Potgieter, Krugersdrop; Peter T. Wedepohl, Randburg, both of South Africa

[73] Assignee: Mintek, South Africa

[21] Appl. No.: 159,837

[22] Filed: Dec. 1, 1993

[30] Foreign Application Priority Data

Dec. 7, 1992 [ZA] South Africa ..... 92/7711

[51] Int. Cl.[6] ..... C22C 38/44

[52] U.S. Cl. ..... 420/67; 420/68; 420/69

[58] Field of Search ..... 420/67, 68, 69, 34

[56] References Cited

U.S. PATENT DOCUMENTS 3,932,174 1/1976 Streicher ..... 420/67

*Primary Examiner*—Deborah Yee

*Attorney, Agent, or Firm*—Tilton, Fallon, Lungmus & Chestnut

[57] ABSTRACT

High chromium stainless steels having enhanced corrosion resistance are provided in which the steels have 25% to 35% by weight chromium; 0.1 to 5% by weight molybdenum; 0.1 to 6% by weight nickel; 0.0 to 4% by weight copper; 0.0 to 1% by weight titanium and/or niobium and/or vanadium; and, 0.02 to 5% by weight of a platinum group metal. The steels are particularly resistant to sulphuric and phosphoric acids.

9 Claims, 3 Drawing Sheets

STAINLESS STEEL COMPOSITION

FIELD OF THE INVENTION

This invention relates to high chromium stainless steels which incorporate nickel and molybdenum as corrosion resistance enhancers. More particularly, but not exclusively, the invention relates to such stainless steels which are particularly corrosion resistant to sulphuric and phosphoric acids under a range of plant conditions.

BACKGROUND TO THE INVENTION

There are commercially available high chromium stainless steels containing molybdenum and nickel, one such steel being Alloy No. 1 identified below.

It is known that small additions of platinum group metals to high chromium stainless steels have the effect of improving corrosion resistance.

It has also been shown that the combination of molybdenum and a platinum group metal in a high chromium stainless steel exhibits a synergistic beneficial effect on the corrosion resistance.

As far as applicant has been able to determine, the following are the closest compositions to the applicant's own invention that have been made or investigated and published in the past. Corrosion rates, in millimeters per annum (mm/a), were measured on samples of the respective stainless steels in boiling 10% by weight sulphuric acid, and the results are as follows:

| Alloy no. | Alloy Composition | Corrosion rate (mm/a) |
|---|---|---|
| (1) | Fe-29% Cr-4% Mo-2% Ni | 0.23 |
| (2) | Fe-29% Cr-4% Mo-0.015% Ru | 1580 |
| (3) | Fe-29% Cr-4% Mo-0.20% Ru | 0.23 |
| (4) | Fe-29% Cr-4% Mo-0.1% Ni-0.01% Ru | 1.04 |

It has now been found that a further and additional synergistic effect is achieved if the chromium, molybdenum, nickel and/or copper, and a platinum group metal are used in combination in certain proportions.

SUMMARY OF THE INVENTION

In accordance with this invention there is provided a high chromium stainless steel comprising:

| | |
|---|---|
| chromium | 25% to 35% by weight; |
| molybdenum | 0.1 to 5% by weight; |
| nickel | 0.1 to 6% by weight; |
| copper | 0.0 to 4% by weight; |
| platinum group metal | 0.02 to 5% by weight; |
| titanium and/or niobium and/or vanadium | 0.0 to 1% by weight; |
| | and, |
| iron | the balance - other than minor constituents and impurities. |

Preferably, the constituents of the stainless steel are present in the following amounts:

| | |
|---|---|
| chromium | 28% to 30% by weight; |
| molybdenum | 3.5 to 4.2% by weight; |
| nickel | 2.0 to 2.5% by weight; |
| copper | 0 to 0.15% by weight; |
| platinum group metal | 0.02 to 0.5% by weight; |

-continued

| | |
|---|---|
| | and, |
| titanium and/or niobium and/or vanadium | 0 to 1.0% by weight. |

Further features of the invention provide for the carbon content to by typically 0.003% by weight, but not more than 0.01% be weight; for the nitrogen content to be typically 0.015% by weight, but not more than 0.02% by weight; for the carbon and nitrogen together to be typically about 0.018% by weight, but not more than 0.025% by weight; or for the alloy to contain higher levels of carbon (up to 0.03% by weight) and nitrogen (up to 0.045% by weight) if titanium and/or niobium and/or vanadium is/are present in an amount of six times the % carbon plus the % nitrogen up to 1% by weight.

A further feature of the invention provides for the platinum group metal to be ruthenium.

The invention also provides a method of producing a high chromium stainless steel as defined above wherein the composition of a commercially available high chromium steel is modified by the addition of the platinum group metal such as ruthenium.

Such a steel is conveniently made by adding at least a part, and preferably all, of the required nickel content and the platinum group metal by means of a nickel-platinum group metal master alloy.

In order that the invention may be more fully understood, corrosion results achieved with various alloy compositions produced to date will now be described in more detail with reference to the accompanying drawings.

DETAILED DESCRIPTION OF EMBODIMENTS OF THE INVENTION

As in the case of the closest compositions to applicant's own invention described above corrosion rates were initially measured on various samples of stainless steels according to the invention in 10% boiling sulphuric acid and the corrosion rate was measured in millimeters per annum.

The following compositions falling within the scope of the present invention were tested and reflected the corrosion rates indicated:

| Alloy no. | Alloy Composition | Corrosion rate (mm/a) |
|---|---|---|
| (5) | Fe-29% Cr-4% Mo-2% Ni-0,20% Ru | 0,001 |
| (6) | Fe-29% Cr-4% Mo-2% Ni-0,11% Ru | 0,001 |
| (7) | Fe-29% Cr-4% Mo-2% Ni-0,06% Ru | 0,001 |
| (8) | Fe-26% Cr-2% Mo-5% Ni-3% Cu-0,2% | 0,016 |

-continued

| Alloy no. | Alloy Composition | Corrosion rate (mm/a) |
|---|---|---|
| | Ru | |

It will be noted that the alloys according to this invention show a marked improvement over all the alloys produced in accordance with the prior art and, in fact, are one or two orders of magnitude lower. A ruthenium content of at least 0,020% and a nickel content of more than 0,1%, as well as the specified combination of chromium and molybdenum exhibit a marked synergistic effect and enhancement of the corrosion resistance of the high chromium stainless steel.

Alloys nos 5, 6 and 7 according to the invention were actually made simply by modifying prior art Alloy No. 1 with the respective amount of ruthenium. These alloys were therefore employed for more extensive testing.

Figure 1:
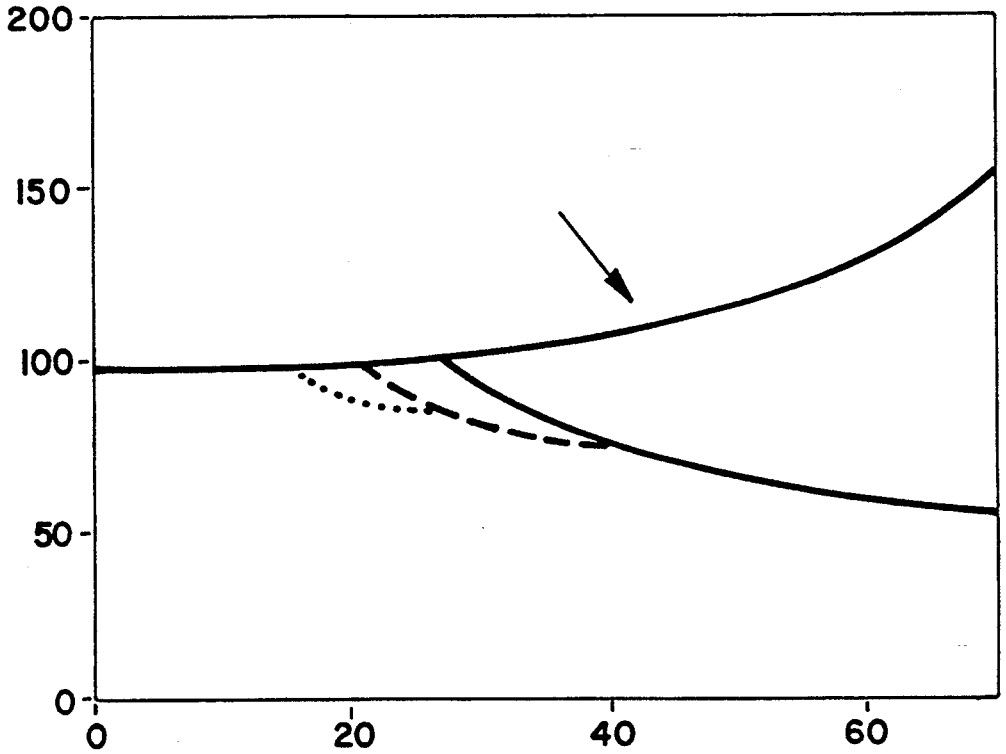
FIG. 1 are the 0.13 mm/a iso-corrosion curve in sulphuric acid for alloys Nos 5, 6 and 7 identified below.

A 0.13 mm/a iso-corrosion curve in sulphuric acid for each of alloys nos 5, 6 and 7 are shown in FIG. 1. The increasing ruthenium content extends the range of both temperature and acid resistance of the alloy.

Figure 2:
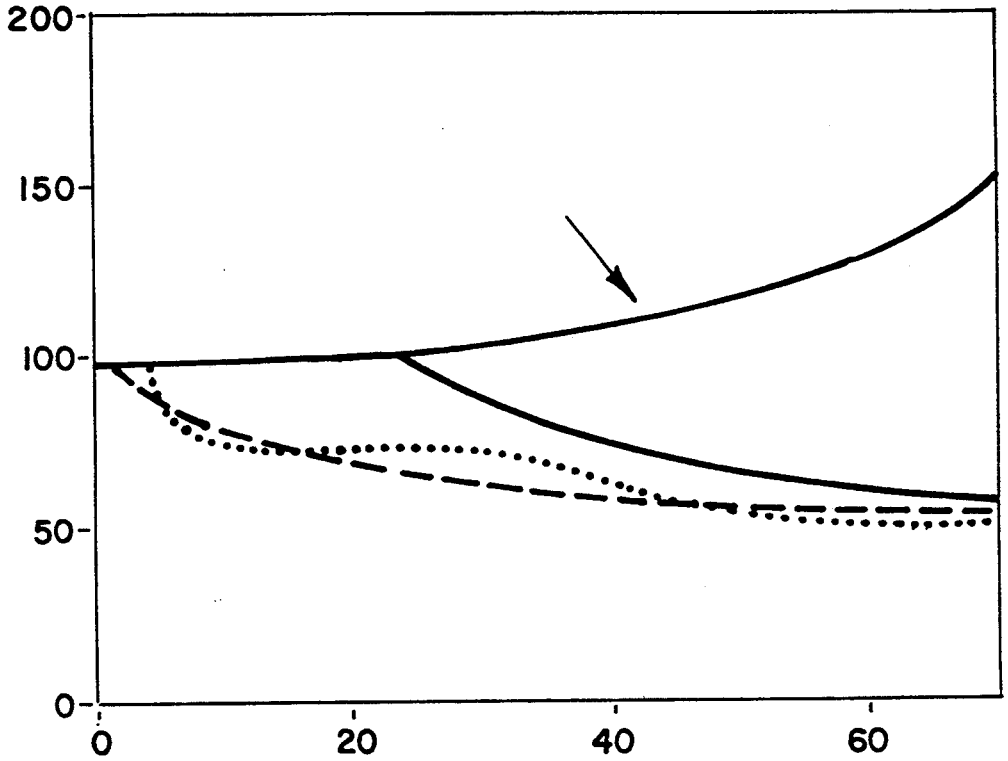
FIG. 2 are the 0.13 mm/a iso-corrosion curve for alloy No. 5, Hastelloy C-276 and Alloy 20Cb3 in sulphuric acid.

FIG. 2 compares the 0.13 mm/a iso-corrosion curve for alloy no. 5 with two commonly used alloys, Hastelloy C-276 and Alloy 20Cb3, in sulphuric acid.

Figure 3:
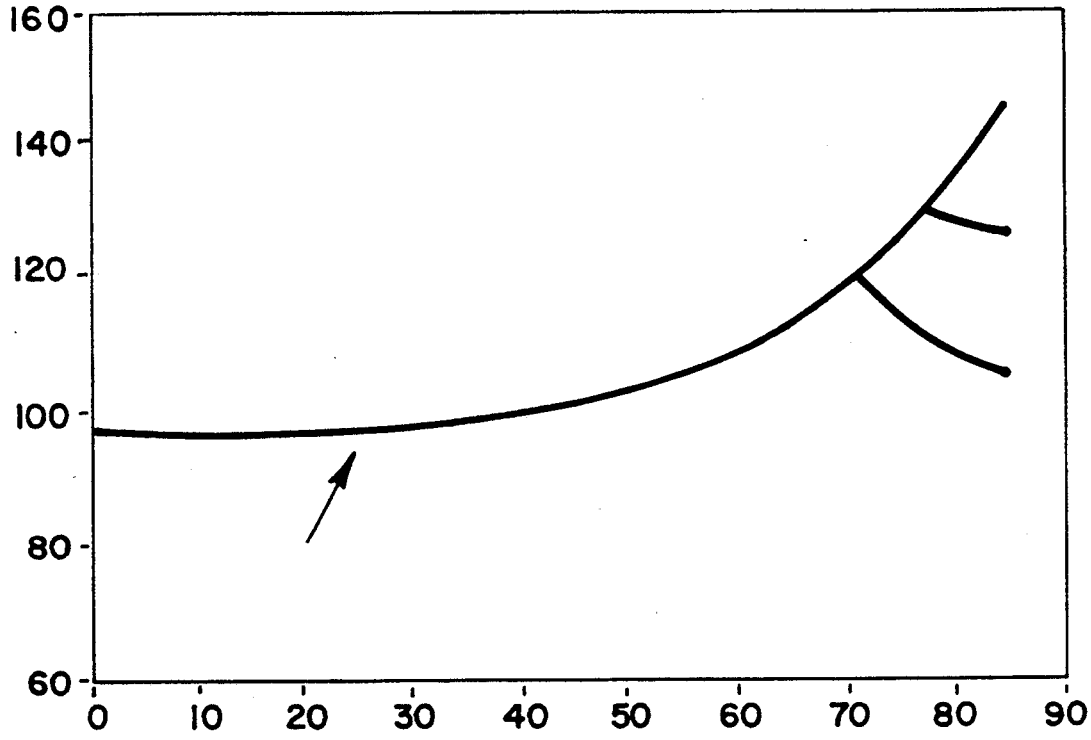
FIG. 3 are the 0.13 mm/a iso-corrosion curve for prior art alloy No. 1 and alloy No. 5 in phosphoric acid; and, FIGS. 4 and 5 are curves illustrating the effect of impurities in phosphoric acid on the corrosion resistance of alloys Nos 1 and 5.

FIG. 3 shows the 0.13 mm/a iso-corrosion curves for prior art alloy no. 1 and alloy no. 5 of the invention in phosphoric acid. The addition of ruthenium has significantly increased the range of usefulness in this reducing acid.

In the wet-manufacture of phosphoric acid, the acid contains impurities which greatly increase the corrosion of proprietary alloys. The most important of these impurities are chloride and sulphuric acid.

Figure 4:
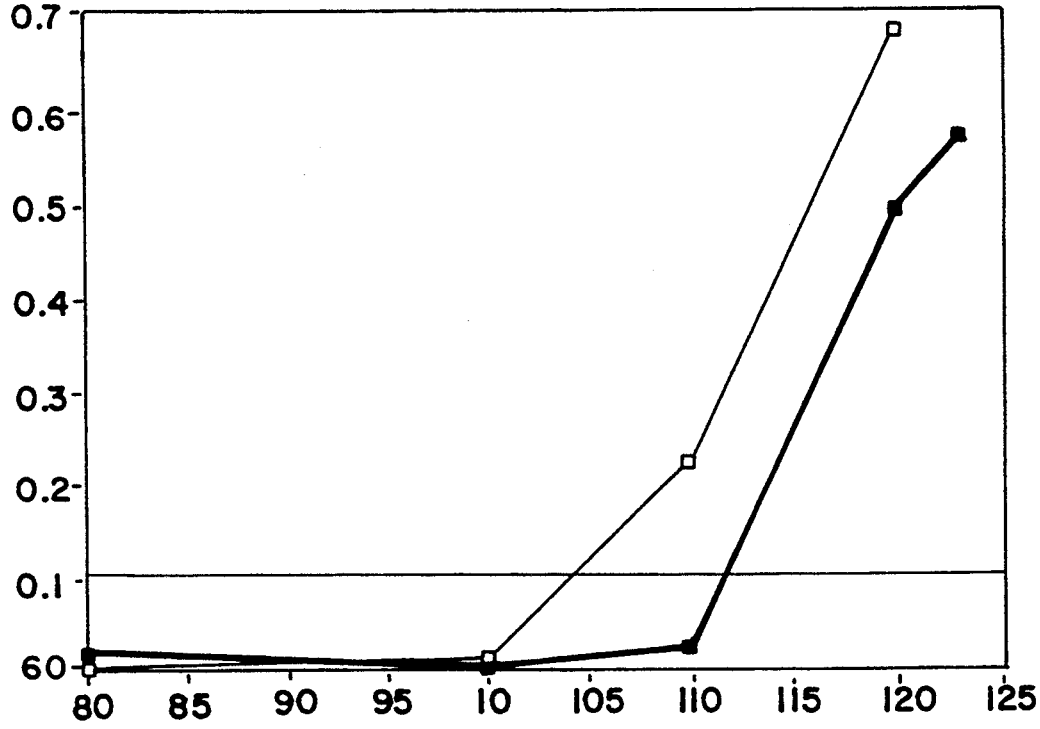
Figure 5:
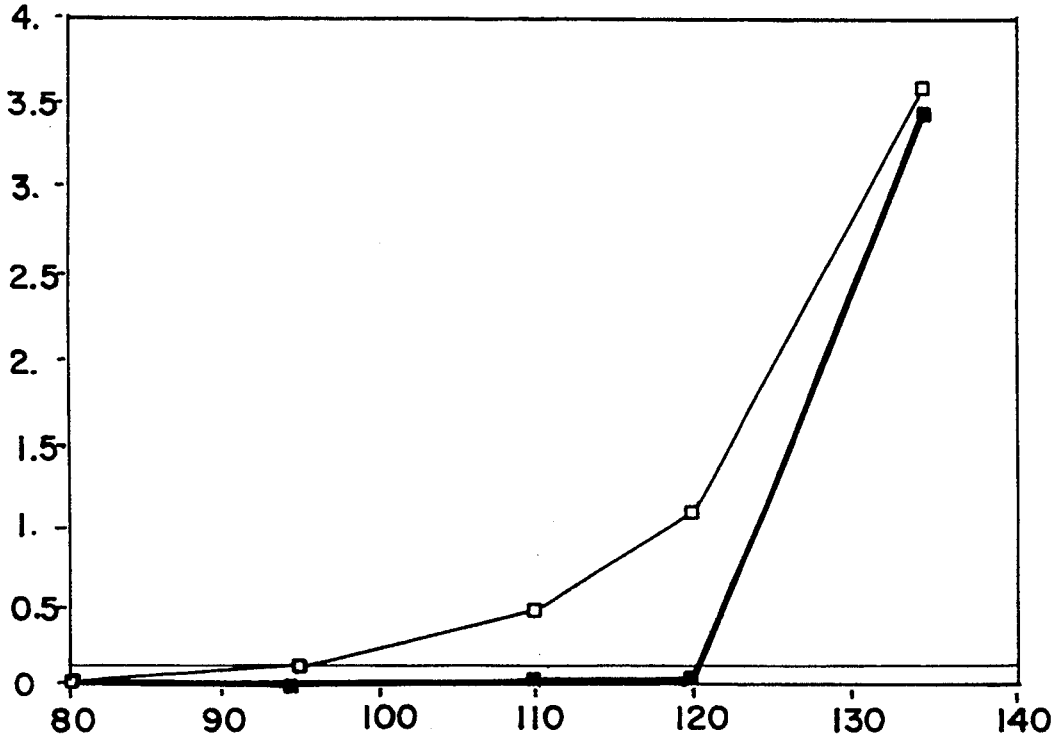

FIGS. 4 and 5 demonstrate the effect of these impurities on the corrosion of prior art alloy no. 1 and alloy no. 5 of this invention in 75% by weight phosphoric acid. This acid concentration is typical of that experienced in a wet-phosphoric acid manufacturing plant. At temperatures greater than 100° C. alloy no. 5 shows a marked improvement over the prior art alloy no. 1 when 500 parts per million chloride and 4% by weight sulphuric acid respectively are present in the 75% by weight phosphoric acid.

Corrosion samples of Alloy No. 6 which were exposed to plant phosphoric acid at 80° C. at a fertiliser plant in South Africa, corroded at a rate of less than 0.1 mm/a. The analysis of the acid is as follows:

$P_2O_5$=42.4%
$H_2SO_4$=3.0%
$F^-$=1.1%
$Cl^-$=400 mg/l
SG=1.53

It is envisaged that other platinum group metals will exhibit a similar effect.

Also the chromium content of the stainless steel may be varied widely.

One preferred alloy has the composition:

| | |
|---|---|
| chromium | 29% by weight |
| molybdenum | 4% by weight |
| nickel | 2% by weight |
| ruthenium | 0.2% by weight |
| niobium + titanium | 0.6% by weight |

This preferred composition is also based on the modification of the composition of an existing commercial alloy (prior art alloy no. 1). This modification does not change the mechanical and physical properties of this alloy that has been proven commercially successful.

One preferred method of platinum group metal addition to the alloy is by means of a nickel-platinum group metal master alloy. This has the advantages that the platinum group metal is more easily distributed throughout the alloy and that the platinum group metal content can be easily calculated from the nickel content. It has been shown that this is a viable method in which to calculate the platinum group metal content. An alternative would be to directly analyse the platinum group metal content which is a complex technique.

Autogenous welding tests on alloy no. 5 indicate no deterioration in the intergranular corrosion resistance and impact toughness.

The invention can, therefore, utilise existing knowledge relating to the mechanical properties, steelmaking and processing of the steel, since the small ruthenium or other platinum group metal addition does not have a significant effect on these.

Typical applications envisaged for stainless steels of this invention are:

a) absorption towers, heat exchangers, pump and vessels in the sulphuric acid and phosphoric acid industries,
b) sea water heat exchangers,
c) biomedical implants, and
d) flue gas desulphurisation (FGD) applications.

The invention therefore provides a range of stainless steels exhibiting greatly enhanced corrosion resistance.

What we claim as new and desire to secure by Letters Patent is:

1. A high chromium stainless steel comprising:

| | |
|---|---|
| chromium | 28% to 30% by weight; |
| molybdenum | 3.5% to 4.2% by weight; |
| nickel | 2.0% to 2.5% by weight; |
| copper | 0.0 to 4% by weight; |
| platinum group metal | 0.02 to 5% by weight; |
| titanium and/or niobium | 0.0 to 1% by weight; and,; |
| and/or vanadium | the balance - other than minor |
| iron | constituents and impurities. |

2. A steel as claimed in claim 1 in which copper is present in an amount of from 0% to 0.15% by weight.

3. A steel as claimed in claim 1 in which the carbon content of the steel is a maximum of 0.01% by weight.

4. A steel as claimed in claim 3 in which the carbon content is about 0.003% by weight.

5. A steel as claimed in claim 1 in which the nitrogen content is at most 0.02% by weight.

6. A steel as claimed in claim 1 in which the combined carbon and nitrogen contents are at most 0.025% by weight.

7. A steel as claimed in claim 6 in which the combined carbon and nitrogen contents is about 0.018% by weight.

8. A steel as claimed in claim 1 in which the alloy contains levels of carbon up to 0.03% by weight and nitrogen up to 0.045% by weight and in which titanium and/or niobium and/or vanadium are present in an amount of up to 1% by weight.

9. A steel as claimed in claim 1 in which the platinum group metal is ruthenium.

* * * * *